United States Patent [19]

Weiss

[11] 4,210,301

[45] Jul. 1, 1980

[54] EAVESTROUGH BRACKET

[76] Inventor: Jacob B. Weiss, 270 Bryden Rd., Kelowna, Bristish Columbia, Canada, V1X 3Y4

[21] Appl. No.: 934,041

[22] Filed: Aug. 16, 1978

[51] Int. Cl.[2] ..... E04D 13/06

[52] U.S. Cl. ..... 248/48.2; 52/16

[58] Field of Search ..... 248/48.2, 48.1; 52/16, 52/95, 96

[56] References Cited

U.S. PATENT DOCUMENTS

| | | | |
|---|---|---|---|
| 472,294 | 4/1892 | Heartley | 248/48.1 |
| 1,867,121 | 7/1932 | Walten | 248/48.1 |
| 2,928,634 | 3/1960 | Bender | 248/48.2 |
| 3,053,491 | 9/1962 | Ramser | 248/48.2 |
| 3,296,749 | 1/1967 | Cotter | 248/48.2 X |
| 3,344,562 | 10/1967 | Miles et al. | 52/96 X |
| 3,737,127 | 6/1973 | Maloney | 248/48.2 |
| 3,752,428 | 8/1973 | Trostle | 248/48.2 |
| 4,000,587 | 1/1977 | Weber | 52/16 |

FOREIGN PATENT DOCUMENTS

| | | | |
|---|---|---|---|
| 654296 | 12/1962 | Canada | 248/48.2 |

*Primary Examiner*—J. Franklin Foss

*Attorney, Agent, or Firm*—Carver and Company

[57] ABSTRACT

An eavestrough bracket formed of a length of stamped sheet metal which has a straight bar portion having an upwardly curved hooked portion at an outer end for engaging an upper hooked marginal edge of an eavestrough and an upstanding leg at an inner end for engaging an opposite upper marginal edge portion of the eavestrough, the leg having an opening for receiving a securing nail, a strengthening rib extending continuously from substantially centrally of the bar portion and upwards through the hooked portion and a trough extending continuously from substantially centrally of the bar portion and upwardly through the upstanding leg and terminating at the hole for guiding a nail to be driven to the opening.

5 Claims, 5 Drawing Figures

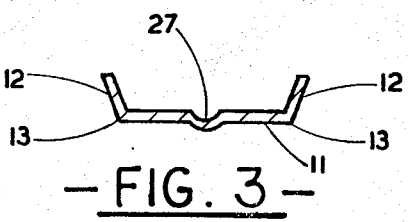
-FIG. 3-
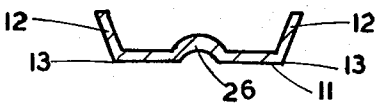
-FIG. 4-
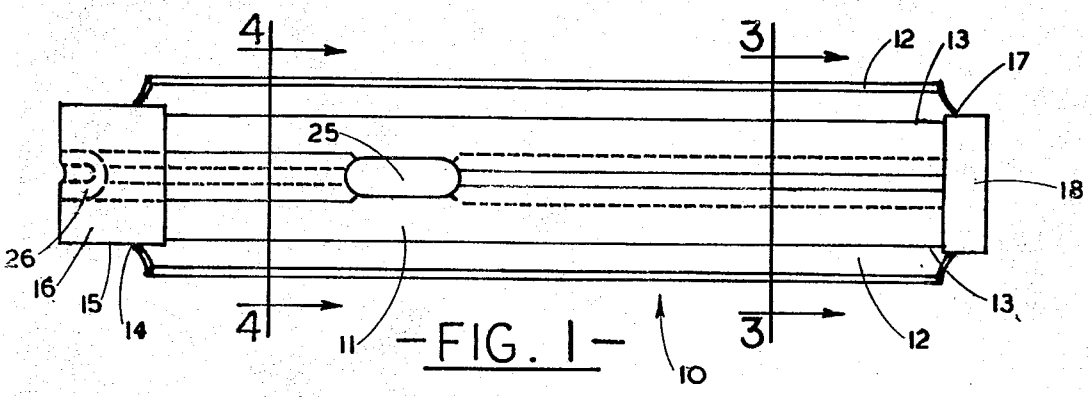
-FIG. 1-
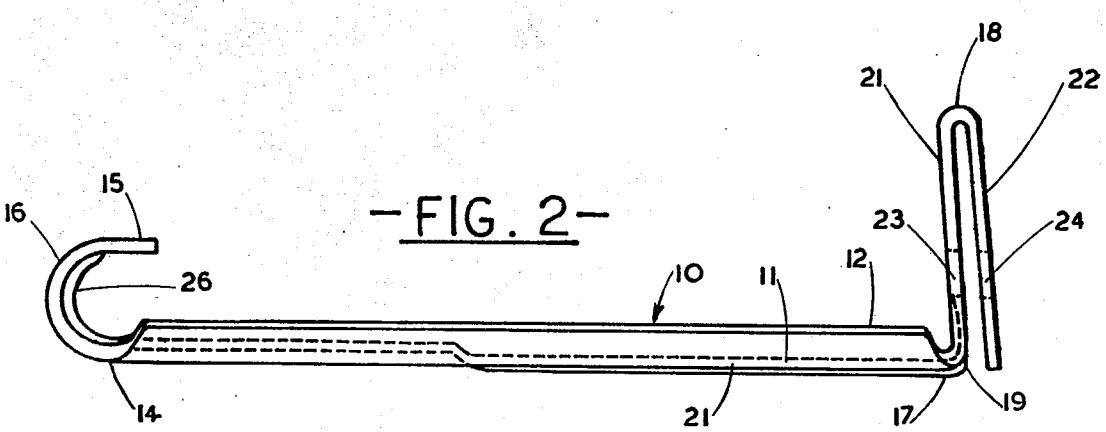
-FIG. 2-

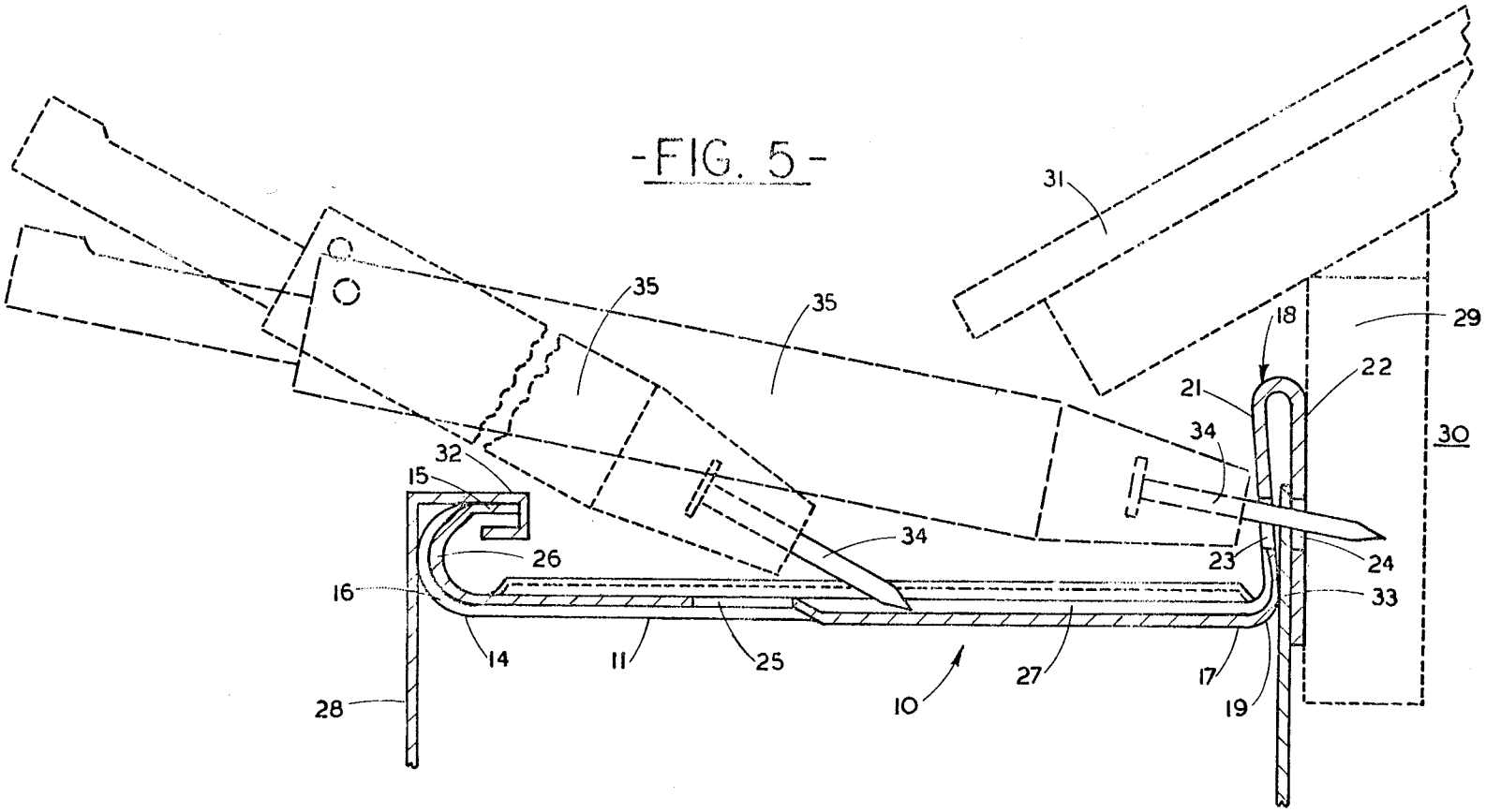
-FIG. 5-

EAVESTROUGH BRACKET

BACKGROUND OF THE INVENTION

1. Field of the Invention

This invention relates to eavestroughing and in particular to brackets for securing eavestroughing to a fascia board.

2. Prior Art

In the installation of eavestroughing, particularly of sheet metal eavestroughing, it is generally the practice to secure the various sections of eavestroughing to the building by means of stamped sheet metal brackets which extend across the eavestrough, and being hooked at one end to engage a cooperatively hooked marginal edge portion of the eavestrough and which have an upstanding leg at the other end provided with an opening for enabling a nailed connection to a fascia board which is normally positioned beneath the roofing overhang. Although such stamped sheet metal brackets have been provided with ribbed reinforcing, the outer hooked end portions quite often break when the eavestrough is struck by snow sliding from the roof of the house.

Further, as the upstanding leg at the opposite end usually extends beneath the roof overhang, the nail receiving openings are quite often hidden to the installer which makes it difficult for him to find the opening with a nail point in order to fasten the bracket to the fascia board.

SUMMARY OF THE INVENTION

The present invention provides an eavestrough bracket which is stronger than the prior art brackets of this type, particularly in the outer hooked end and which is provided with guidance means which automatically guides a nail to the nail receiving opening in the leg.

The eavestrough bracket of the present invention which is formed of a stamped length of sheet metal has a straight bar portion adapted to extend across an eavestrough having an upwardly hooked portion at an outer end for engaging a cooperatively inwardly hooked marginal edge portion of the eavestrough, a centrally located rib extending from substantially the middle point of the bar portion and upwardly around the hooked portion, an upstanding leg at the opposite end of the bar portion having a nail receiving opening and a trough extending continuously from substantially the mid point of the bar portion upwards along the leg and terminating at the opening therein for guiding a nail point to the opening.

A detailed disclosure following, related to the drawings, gives exemplification of the eavestroughing bracket according to the invention which, however, is capable of expression in means other than that particularly described and illustrated.

DESCRIPTION OF THE DRAWINGS

FIG. 1 is a plane view of the eavestrough bracket,

FIG. 2 is a side elevation thereof,

FIGS. 3 and 4 are sectional views taken on line 4—4 and 5—5 respectively of FIG. 1, and FIG. 5 is a central sectional view of the bracket in position across an eavestrough being applied to a fascia board of a building.

DETAILED DISCLOSURE

Referring to the drawings, the eavestrough bracket 10 is formed of a length of sheet metal, preferably aluminum, which is so stamped to provide an elongated, substantially rectangular, straight body portion 11 having straight upturned marginal side portions 12—12 which are bent upward along foldlines 13—13 at approximately 60 degrees to said body portion, said side portions 12—12 serving as strengthening members.

The body portion 11 terminates at one end 14 in an upwardly turned hooked portion 15 having a semi-circular bight portion 16. The opposite end 17 of the body portion terminates in upwardly, reversely bent leg 18, junction between the leg and the body portion being provided by a short radius junction portion 19. The reversely bent leg, it is seen, has a pair of substantially parallel arms 21 and 22 which are provided with registering openings 23 and 24 spaced above the junction portion 19.

The body portion has a centrally located hole 25 for acceptance of a conventional reinforcing stay, not show. The body portion 11 and bite portion 16 are also indented to provide an upwardly convex rib 26 which extends continuously from the hole 25 and upwardly around the bight portion 16. The body portion 11 extending in an opposite direction from the hole 25, the junction portion 19 and the arm 23 are also provided with a centrally located continuously extending indentation providing a concave trough 27 which terminates at the opening 23 in the arm 21 of the leg.

Referring now to FIG. 5, the bracket 10 is shown in use in securing an eavestrough 28, shown only partially, to a fascia board 29 of a building 30, roofing 31 of which overhangs the fascia board. The hooked portion 15 of the bracket is engaged in a correspondingly inwardly hooked marginal edge portion 32 of the eavestrough and the inner marginal edge portion 33 of the eavestrough which is straight is fitted between the arms of the upstanding leg 18. The upstanding leg is then positioned against the fascia board and a nail 34 is positioned in the opening 23 of the arm 21 and is driven through the marginal edge portion 33 of the eavestrough into the fascia board.

As shown in FIG. 5, it is common practice, due to the interference of roofing overhang and the eavestrough to use a nail punch 35, shown in broken outline in two positions. Even with the use of the nail punch, however, an installer who might be standing on a ladder is rarely in a position, due to the roofing overhang, to see the nail receiving opening in the leg and he must therefore feel for the opening with the nail point. With conventional type brackets, this is quite difficult to do and is extremely time wasting.

The bracket 10, however, by virtue of the trough 27 simplifies the operation. As shown in FIG. 5, the nail point simply need be placed in that portion of the trough 27 which extends longitudinally of the bar portion and which is always visible to the installer as it extends outwards beyond the roof overhang. The nail point is then slid along the trough and upwards on the leg, the trough guiding the nail point directly to the opening. Guidance provided by the trough not only speeds the operation of finding the opening but also enables the opening to be positioned higher up the leg than is possible with prior art brackets as the opening can always be found very easily by positioning the nail receiving opening higher on the leg and a stronger than normal connection is obtained. It is also seen that by extending the rib 26 around the bight of the hooked portion, the hooked portion is greatly strengthened and will not, ordinarily, bend or break under the impact of snow sliding down the roof and striking the eavestrough.

I claim:

1. An eavestrough bracket for an eavestrough having an inwardly hooked outer marginal edge portion and an upwardly extending inner marginal edge portion comprising:

(a) a straight body portion adapted to extend across the eavestrough between said marginal edge portions, (b) an upwardly hooked portion at one end of the body portion having a semi-circular bite for engaging in the inwardly hooked marginal edge portion of the eavestrough, (c) an upstanding leg at an opposite end of the body portion for engaging the opposite marginal edge portion of the eavestrough, said upstanding leg having a nail receiving opening, (d) a trough extending continuously from substantially the middle length of the bracket and upwardly along the leg and terminating at the opening therein for guiding a point of a nail along the body portion to the opening.

2. A bracket as claimed in claim 1 including an upstanding rib extending longitudinally of the bracket from substantially the middle point of the body portion upwardly around the bight of the hook portion.

3. A bracket as claimed in claims 1 or 2 in which the bracket is formed of a stamped length of sheet metal and wherein said rib and said trough are formed by continuous indentations.

4. A gutter bracket as claimed in claims 1 or 2 in which the upstanding leg is reversely bent to form an inverted U having two arms for receiving the inner marginal edge of the eavestrough.

5. A gutter bracket as claimed in claims 1 or 2 including upwardly bent marginal edge portion extending longitudinally of the body portion of the bracket for providing longitudinal reinforcement of the said body portion.

* * * * *